United States Patent [19]

Patzwahl

[11] Patent Number: 4,514,953

[45] Date of Patent: May 7, 1985

[54] DEVICE FOR REMOVING AIR FROM FILLED BOTTLES OR OTHER CONTAINERS

[75] Inventor: Hans-Jürgen Patzwahl, Bad Abbach, Fed. Rep. of Germany

[73] Assignee: KRONES AG Hermann Kronseder Maschinenfabrik, Neutraubling, Fed. Rep. of Germany

[21] Appl. No.: 593,282

[22] Filed: Mar. 26, 1984

[30] Foreign Application Priority Data

Mar. 26, 1983 [DE] Fed. Rep. of Germany ..... 3311200

[51] Int. Cl.[3] ..... B65B 31/04; B65B 57/00

[52] U.S. Cl. ..... 53/52; 53/79; 53/510; 141/70; 141/167; 141/183

[58] Field of Search ..... 53/52, 64, 79, 88, 94, 53/111 R, 431, 432, 510; 141/37, 66, 70, 167, 183

[56] References Cited

U.S. PATENT DOCUMENTS 2,218,911 10/1940 Hopkins ..... 141/70

2,267,744 12/1941 Nordquist ..... 141/70

FOREIGN PATENT DOCUMENTS 1438364 6/1976 United Kingdom ..... 141/70

*Primary Examiner*—Robert L. Spruill

*Assistant Examiner*—Richard M. Mudd

*Attorney, Agent, or Firm*—Fuller, House & Hohenfeldt

[57] ABSTRACT

Air in the space above the fill level in the neck of a bottle or similar container is displaced before the closure is applied, by injection of a liquid or gaseous medium that causes the product to foam. The system consists of a filling station, a closure station, a star wheel to transfer bottles between the two stations, and a jetting device. The jetting device is mounted to a horizontal holding arm above the transfer star and pivots concentrically around the axis of the transfer star. The conveyor speed is automatically monitored by a tach generator. Its signal activates a servo motor which engages the holding arm and moves it together with the jetting nozzle along the bottle path according to the operating speed. The jetting device is moved closer to the closure station at lower operating speeds while its distance to the closure station is increased during higher speeds. This prevents, without operator involvement, excessive foaming which results in product loss or insufficient foaming which results in high air content of the product.

8 Claims, 2 Drawing Figures

Fig. 1
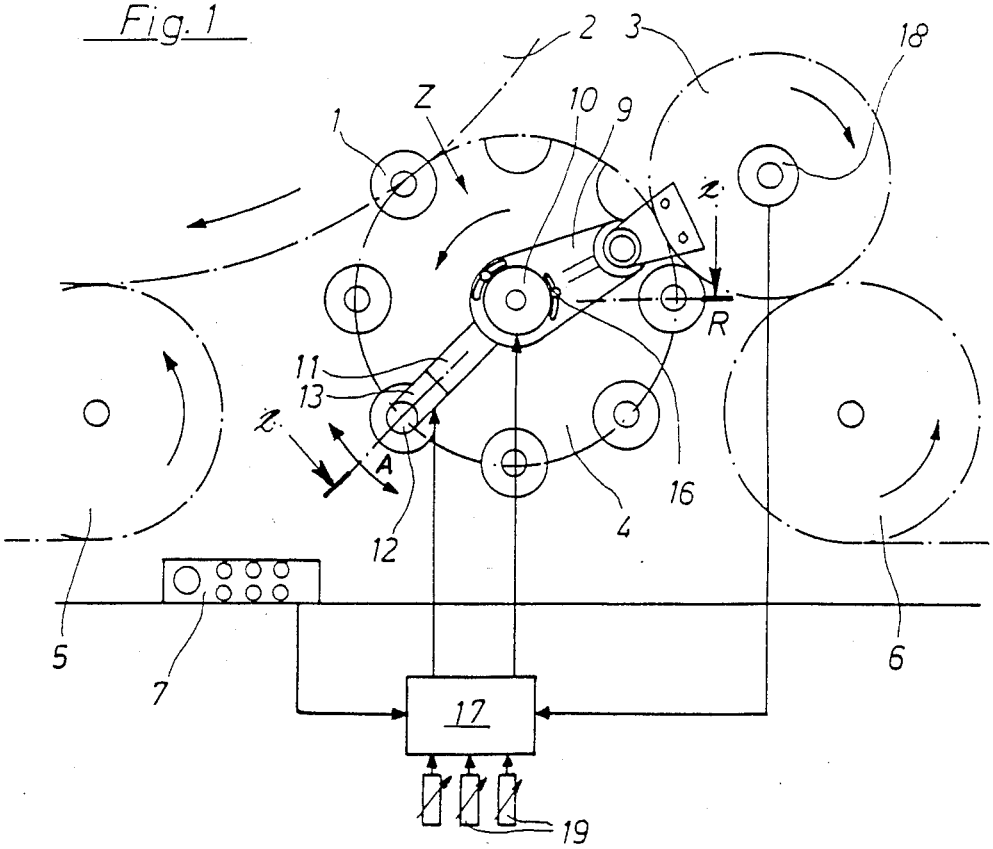
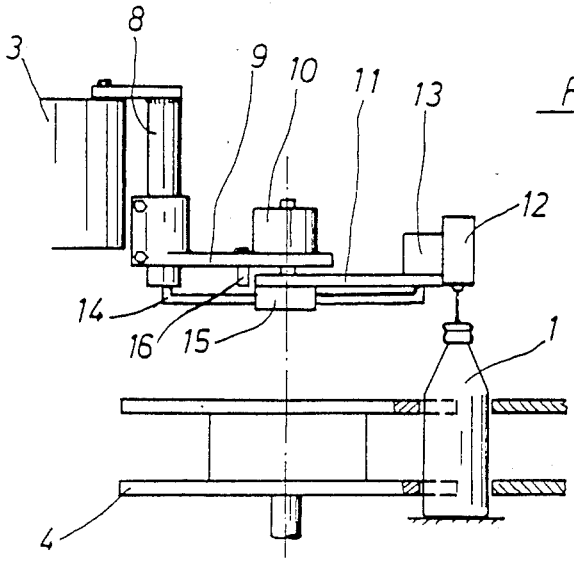
Fig. 2

DEVICE FOR REMOVING AIR FROM FILLED BOTTLES OR OTHER CONTAINERS

BACKGROUND OF THE INVENTION

This invention relates to a device for removing air from the space above the fluid in containers such as bottles before the closure device is applied to the container.

The invention is particularly applicable in cases where containers are filled with a foaming liquid, such as beer, where it is desired to remove the air above the liquid level before a crown closure is applied to the bottle. As is known, air may cause degradation of the beer in time and bring about a corresponding reduction in its shelf life. A known practice for removing the air from the unfilled neck of the bottles is to inject a medium directly into the bottle opening under pressure to thereby cause a controlled foaming of the contents of the bottle in which case the foaming displaces the air in the neck before closure. Typically, the pressurized injection medium may be sterile water, the filling liquid itself, carbon dioxide gas or other medium that is compatible with the particular fluid in the bottle. The new air removal device will be described in reference to filling beer bottles that are typical of those whose contents foam when a jet of carbon dioxide is directed into the bottle under pressure. The term "bottle" is understood to encompass other containers that are closed or capped after air is excluded.

It is very important to apply the cap within a specific time range after the air displacement medium is injected so air does not flow back in before the closure is applied. It is also important to avoid excessive foaming since this causes loss of fluid product and consequent lowering of the correct fill level as well as contamination of the closure device, while too little foaming action results in high air content of the product which in turn affects taste and shelf life as previously mentioned.

There are prior art devices for excluding air from bottles. One such device comprises an injector mounted on an arm that extends over a bottle that is being transported in the starwheel on the discharge side of a bottle filling machine. The injector is adjustable and can be set in various positions relative to the place at which the bottle closure is applied which, in effect, allows adjustment of the time between the air displacement medium injection and closure application. This manual timing adjustment is made by an operator for a certain product at the beginning of a filling operation and operates at maximum efficiency only for a single filling speed. If filling speed or bottle transport speed is increased, the duration of the injection becomes shorter and the foaming action inadequate. If, however, the filling speed is decreased, the duration of the injection becomes longer and the liquid product overflows. Therefore, the device just described only works at maximum efficiency at a single speed. Speed variations that commonly occur during normal operating conditions result in the deficiencies which were just described. As a consequence, it has been suggested to conduct the jetting operation at different pressure levels that automatically adjust to the speed of the bottle filling and closure application equipment.

Precise control of the foaming action over a wide speed range through pressure regulation, however, presents a problem due to the relatively small jetting orifice and low quantity of jetting medium used. It is further complicated by the chemical and physical interaction during the foaming process.

There is another prior art device for foaming of liquid in bottles to exclude air. In this device a jetting nozzle is mounted to a horizontal arm which is eccentrically adjustable to the axis of the starwheel on the discharge side of the filling machine. During equipment stoppages, the arm is located away from the bottles. Automatic synchronization of the varying equipment speeds is not intended nor possible since the jetting device is merely moved between its active and inactive position.

SUMMARY OF THE INVENTION

The basic objective of the present invention is to provide a device that produces uniform foaming action over a wide bottle transport speed range.

Briefly stated, the present invention relates to a method for automatically regulating the foaming process for various conveying speeds through the adjustment of the distance between the jetting nozzle and the closure unit without requiring involvement by operating personnel. Thus, the dangerous procedure of making a manual adjustment during operation of the machinery is eliminated. Moreover, time is saved since it is not necessary to remove any guards from the machinery to make an adjustment since adjustment or adaptation to conveying speed is automatic.

In accordance with the invention, the proper position of the nozzle for the various speeds is easily determined since the elapsed time between the injection and the foaming process remains constant provided the injection pressure is also constant. This, consequently, results in a linear relationship between the point of injection and conveyor speed provided no extreme speed changes occur. In accordance with the invention, methods to control the position of the nozzle vary according to the filler operation and the production procedures.

In accordance with the invention, provisions are made for obtaining optimum foaming action under most filling conditions and production situations. However, for technical reasons, operation of the bottle filling equipment with constantly changing speed is not desirable. In most cases all operating conditions can be covered with a set operating speed and a maximum operating speed and, for special situations, a jog speed. In such case a simple control system that will accommodate two or a few conveying speeds is satisfactory. A filling unit may also be operated at a single set operating speed in which case provision is made for a two-state control system to accommodate operating conditions and a stop condition.

Another feature of the invention is to provide for the variation in the time interval between jetting and closing which occurs in connection with acceleration and deceleration of the apparatus in a very short time span, such as several seconds, in contrast to changes of operating and maximum speeds in controlled steps. Such a system applies ideally to most operating situations.

A further feature of the invention is to keep the elapsed time between injection and closure constant since the foam height at constant injection pressure is mainly dependent on elapsed time. Various sensing devices are available for monitoring the conveyor speeds.

A further feature of the invention is that conveyor speed is detected with a tachometer generator which enables more precise control of the foaming process.

An additional or alternative feature of the invention is that it can be used in combination with a control system for the jetting unit, filling or closure unit to allow sensing of the start-stop phase through the control impulse of the drive unit.

Other features and advantages of the new air exclusion device will be evident in the more detailed description of a preferred embodiment of the invention which will now be described in detail in reference to the drawing.

DESCRIPTION OF THE DRAWING

FIG. 1 is a diagrammatic plan view of a bottle closure applying machine in which the new air exclusion device is incorporated; and FIG. 2 is an elevational view, partly in section, of the machine shown in FIG. 1.

DESCRIPTION OF A PREFERRED EMBODIMENT

The apparatus shown in FIGS. 1 and 2 is used for filling and closing or capping of bottles which are designated by the reference numeral 1. The bottle filling station is represented symbolically and given the reference numeral 2. The station has a rotating bottle table which fills the bottles 1 by means of the counter-pressure method up to a certain fill level with a fluid such as beer, leaving it practically free of foam. In FIG. 1 there is a symbolic representation of a closure application unit 3 that has a rotating bottle table that applies closures such as crown caps to the bottles. A transfer star 4, rotating about a vertical axis and equipped with pockets conforming to the bottle size and shape is also shown. The starwheel 4 serves to transfer the bottles 1 from the filling station 2 to the closure unit 3.

Not shown is a common drive unit that drives infeed starwheel 5, the bottle table of the filler unit 2, the transfer starwheel 4, the bottle table of the closure unit 3 and the discharge starwheel 6 synchronously in the direction indicated by the arrows. Starting and stopping as well as speed functions are controlled by way of the control panel 7.

Mounted to the closure unit head 3 is a vertical column 8. An arm 9 is clamped to column 8 and is adjustable in height and positioned precisely above transfer starwheel 4. A rotary magnet 10 is mounted to the top of arm 9 and positioned concentrically to the axis of the transfer starwheel 4. The rotary magnet 10, in effect, acts somewhat like a servomotor in that it rotates to a specific angular position in correspondence with the signal level that it receives. A horizontal arm 11 is mounted to the shaft of the rotary magnet 10 and, at the radially outward end of the arm 11 a jetting nozzle 12 and a control solenoid 13 for the nozzle are mounted. The jetting nozzle is at a radial distance from the rotational axis of rotary magnet 10 which results in the vertically directed nozzle pointing directly into the bottle opening. The jetting unit 12 is supplied with air displacement medium from a rotary manifold 15 which is coupled to the jet nozzle by way of a pressure joint 14. The manifold is supplied with a jetting medium such as beer from a reservoir, not shown, at a predetermined pressure. Due to the precise alignment of the starwheel axis 14 and the rotary magnet 10 axis, the jetting nozzle 12 points exactly into the opening of the bottles rotated by the transfer star 4 independent of the rotational angle of the horizontal arm 11. The limits through which arm 11 can swing are established by limit stop pins 16 mounted on the support arm 9. The design of the rotary magnet 10 allows precise positioning of the arm 11 to the jetting nozzle 12 within its adjustment range and is connected to control unit 17 and solenoid 13.

A sensor in the form of a tachometer generator 18 mounted to the shaft of the bottle table of the closure unit 3 senses the rotational speed of the closure unit bottle table and, accordingly, the machine conveyor speed. The signals from speed sensor 18 are supplied to a control unit 17 that processes the signals and is also connected to a control panel 7 that allows the user to select functions through generation of electric signals. Control unit 17 is operative to determine the circumferential position of the jetting nozzle 12 according two different basic programs. Any adjustment of the filling machine 2 output speed or the conveyor speed made through the agency of control panel 7 in either the high speed range or anywhere between the maximum operating speed and minimum speed automatically positions the jetting nozzle 12 to insure the desired amount of foaming of the product immediately before the crown or closure is applied to the bottle. Accordingly, arm 11 and nozzle 12 on it rotates or swings clockwise during machine speed increases, that is, distance is increased between the jetting station A and the closure station 3, but the arm 11 is caused to rotate counterclockwise to reduce the time and distance between the jetting station and the closure station when machine speed is decreased. Thus, the elapsed time between injection and closure application remains constant regardless of machine speed. This prevents excessive foaming and overflow of the bottle contents and eliminates significant air pickup by the product that would be caused by too little foaming action. The injector jet 12 can be moved between an active position A to a rest position R, the latter of which is near the closure application station. Both extreme positions of arm 11 and the jet thereon and its relative position to the filling machine output speed can be adjusted with variable elements such as potentiometers 19 affiliated with control unit 17 to conform to prevailing operating conditions, especially to the foaming characteristics of the particular product contained in the bottles. If a stop of filling unit 2 operation occurs where all components come to a complete stop only after several seconds of coasting, the swingable arm 11 with the nozzle 12 on it is automatically moved counterclockwise, as in FIG. 1, from its working position A to its resting position R closure to the closure unit 3. Motion of arm 11 to resting position R is completed at approximately the same time that all machine components come to a complete stop with some higher speed necessary due to the drastic reduction of the conveyor speed during the positioning of the arm 11 at rest position R. This prevents excessive foaming during the critical slow-down phase without operator involvement. In addition, solenoid 13 turns off jetting nozzle 12. This procedure is reversed during start up of the bottle filling unit at which time the jetting nozzle 12 is activated or opened through solenoid 13 and moves from rest position R into its working position A. Again, the travel speed of the jetting nozzle during the start up phase is somewhat higher to compensate for bottle acceleration at this time. This control method can also be used where varying operating speeds do not exist. The rotary magnet 10 is not required in such case and is replaced by a motor and gear train, not shown, that automatically positions the jetting nozzle as needed. It is also possible to activate the solenoid with a time delay relay to achieve exact foaming during the critical start and stop phase.

I claim:

1. Apparatus for displacing air from above the fill level in containers such as bottles that are in transit to a container closing unit, comprising:

a nozzle located for injecting a jet of a medium into the moving open container to effect said air displacement and movable means to which said nozzle is mounted for being moved selectively closer to and farther from said container closing unit, means for determining the speed at which said containers are transported and drive means controlled by speed determining means to drive said moveable means to locate said nozzle farther from said container closing unit for increasing transport speed and closer to said closing unit for decreasing transport speed so that the elapsed time between injecting said medium and closing of the containers remains substantially constant.

2. Apparatus for displacing air from above the fill level in containers such as a series of bottles that are being conveyed away from a container filling unit, comprising:

a rotatably driven container transfer member having means for engaging said containers consecutively as they are being conveyed and for transporting the containers in a circular path, a container closing unit located on said circular path, arm means mounted for rotating about the rotational axis of said driven member and a nozzle mounted on said arm means for injecting into the containers transported by said driven member, a medium to effect the displacement of said air, means for determining the speed at which said containers are transported and drive means controlled by said speed determining means to rotate said arm means to located said nozzle means farther from said container closing unit as transport speed increases and closer as transport speed decreases so the elapsed time between injecting said medium and closing of said containers remains substantially constant for the filling and closing operation that is in progress.

3. The apparatus according to claim 2 wherein said drive means for said arm means is a rotary magnet.

4. The apparatus according to claim 2 wherein the radial length of said arm means is adjustable.

5. The apparatus according to claim 2 including means for selecting one of a plurality of defined conveyor speeds, said speed determining means responding to said selection by causing said drive means for said arm means to locate said nozzle means at a distance along said circular path from said closing unit that results in a predetermined desired elapsed time for the containers to move from said nozzle means to said closing unit.

6. The apparatus according to claim 2 wherein when said speed determining means determines that said apparatus is decelerating to a stop and said means controls said arm drive means to move said nozzle means correspondingly closer to said closing unit to position the nozzle means in a rest position adjacent the closing unit when the apparatus reaches a complete stop.

7. The apparatus according to claim 2 wherein when said speed determining means determines that the apparatus is operating at a predetermined normal speed said means controls said arm drive means to locate said nozzle means in working position (A) at a particular angle along said circular path from said closing unit and when said apparatus is stopped said speed determining means controls said arm drive means to locate said nozzle means at a rest position (R) adjacent said closing unit and the movements from positions A to R and R to A are made during apparatus deceleration and acceleration respectively in one continuous motion.

8. Apparatus for displacing air above the fill level in a series of containers such as bottles that are in transit to a container closing unit, comprising:

a transfer unit including a rotationally driven member adapted for engaging upright containers consecutively and moving the containers in a circular path to said closing unit, arm means mounted for rotating about an axis coincident with the axis of said driven member, a nozzle mounted to said arm means for projecting a jet of fluid medium at the same radial distance as said circular path into the containers transported by said transfer unit to cause said air displacement, means for determining the speed at which said containers are transported and drive means controlled by said speed determining means for driving said arm means rotationally to position said nozzle means along said circular path farther from said container closing unit as transport speed increases and closer to said unit as transport decreases so that the elapsed time between the elapsed time between injecting said medium and closing of the containers remains substantially constant.

* * * * *